US006311400B1

(12) United States Patent
Hawes et al.

(10) Patent No.: US 6,311,400 B1
(45) Date of Patent: Nov. 6, 2001

(54) SAFETY RAZOR

(75) Inventors: Christopher Martin Hawes, Streatly-On-Thames (GB); Chrispin Miller, Lincoln, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/463,471

(22) Filed: Jan. 20, 2000

Related U.S. Application Data

(63) Continuation of application No. PCT/GB98/02071, filed on Jul. 13, 1998.

(30) Foreign Application Priority Data

Jul. 22, 1997 (GB) ..... 9715501

(51) Int. Cl.[7] ..... B26B 21/52
(52) U.S. Cl. ..... 30/527; 30/50; 30/57
(58) Field of Search ..... 30/50, 526, 527, 30/47, 62, 57

(56) References Cited

U.S. PATENT DOCUMENTS

| | | | | |
|---|---|---|---|---|
| 1,423,414 | | 7/1922 | Glaser . | |
| 1,491,596 | * | 4/1924 | Everett | 30/62 |
| 3,311,975 | * | 4/1967 | De Longuyon | 30/62 |
| 4,275,498 | | 6/1981 | Ciaffone . | |
| 4,475,286 | | 10/1984 | Saito . | |
| 5,249,361 | | 10/1993 | Apprille et al. . | |
| 5,533,263 | * | 7/1996 | Gilder | 30/527 |
| 5,535,518 | * | 7/1996 | Althaus | 30/527 |
| 6,122,826 | * | 9/2000 | Coffin et al. | 30/527 |

FOREIGN PATENT DOCUMENTS

| | | |
|---|---|---|
| 20815 | 1/1981 | (EP) . |
| 320626 | 6/1989 | (EP) . |
| 2066133 | 7/1981 | (GB) . |
| 2116470 | 9/1983 | (GB) . |
| WO-89/01394 | 2/1989 | (WO) . |
| WO-97/25190 | 7/1997 | (WO) . |
| WO-97/26119 | 7/1997 | (WO) . |
| WO-97/33729 | 9/1997 | (WO) . |

* cited by examiner

*Primary Examiner*—Hwei-Siu Payer
(74) *Attorney, Agent, or Firm*—Charles P. Boukus, Jr.; Donal B. Tobin

(57) ABSTRACT

A safety razor includes a suspension structure for supporting a blade unit (2) on a handle (1) so that the blade unit (2) is able to pivot about a longitudinal axis A and is able to move downwardly towards the handle (1), but is restrained from movement in a direction perpendicular to the permitted downward movement. The suspension structure includes a pair of arms (21) each including a rigid part (22) coupled between resilient parts (23 and 24). The free ends of the arms (21) carry pivot pins (15) and are interconnected by a strut (16) which may carry a leaf spring (18) to act on the underside of the blade unit to bias the blade unit to a rest position about the pivot axis.

49 Claims, 5 Drawing Sheets

SAFETY RAZOR

This is a continuation of International Application No. PCT/GB98/02071, with an international filing date of Jul. 13, 1998.

This invention is concerned with safety razors and more especially, the invention relates to a safety razor in which a blade unit is mounted on a handle by a supporting structure permitting movement of the blade unit relative to the handle for following the contours of the skin as the blade unit is moved across the skin during shaving. In particular, the invention disclosed herein resides in a support structure providing for the blade unit a suspension allowing movement of the blade unit towards the razor handle.

There have been various proposals for mounting a blade unit on a handle to enable movement of the blade unit with the intention of maintaining conformity of the skin contacting parts with the skin surface during shaving. For example, many razors currently marketed have blade units which are pivotable about longitudinal axes parallel to the blade edges. In our prior patent application No. GB-A-2116470 there is described a razor in which the blade unit supporting structure also allows pivotable movement about a transverse axis. A safety razor disclosed in WO 89=l /01394 has a blade unit support structure constructed so that the blade unit is pivoted on journals formed at the ends of two parallel arms, pivotal movement of the blade unit from a rest position is opposed by a cam arrangement, and the two arms are retractable against springs acting thereon under forces generated by pressing the blade unit against the skin so that the cam arrangement disengages to allow substantially free pivotal movement of the blade unit. With the known constructions, however, the ability of the blade unit to respond to chances in the skin surface contours in order to follow those contours with a view to improving shaving performance is limited by constraints imposed on the blade unit movements by the support structure.

There is proposed in our copending International patent application No. PCT/GB97/00121, an arrangement for mounting a blade unit to a handle which provides for improved freedom of movement of the blade unit relative to the handle by use of several spring suspension devices. More particularly, the blade unit is capable of movement with several degrees of freedom including pivotal movement about a longitudinal axis, pivotal movement about a transverse axis and translational movement in a direction generally towards the handle and substantially perpendicular to a plane defined by the longitudinal and transverse axes. The position of the transverse axis is not fixed and the embodiments described in the aforesaid application allow end-to-end tilting of the blade unit.

The present invention has for its object to provide a blade unit supporting structure capable of achieving the freedom of movement proposed according to the invention of the aforementioned international patent application whilst being convenient to manufacture and allowing a uniform pivoting characteristic with respect to the longitudinal axis which need not be influenced by other blade unit displacements.

Embodiments of the present invention as described herein comprise a structure for supporting an elongate blade unit with respect to a handle structure, there being a blade unit engaging structure that engages the blade unit and provides pivotal mounting of the blade unit about a pivot axis that is parallel to a longitudinal axis of the blade unit, and a resiliently deformable arm structure connected between the handle structure and said blade unit engaging structure. The arm structure permits displacement of the engaging structure downwardly towards the handle structure whilst restraining movement of the engaging structure in a direction substantially perpendicular to the direction of downward displacement.

Stated more specifically the present invention provides a blade unit supporting structure for suspension mounting of an elongate blade unit to a handle in a safety razor, the structure comprising a blade unit engaging section including at least one pivot element defining a pivot axis substantially parallel to the length of the blade unit for pivotal movement of the blade unit about said axis, and a suspension section or yoke including a hub for firm attachment to the handle and a pair of arms extending symmetrically from the hub and connected to respective portions of the blade unit engaging section disposed to be adjacent opposite ends of the blade unit, the arms being resiliently displaceable to permit independent movement of each end of the blade unit towards the handle from a rest position to which the blade unit is biased by the arms, and the arms restraining movement of the engaging section, and thereby the blade unit, in a direction substantially perpendicular to a plane defined by said direction of movement towards the handle and said pivot axis.

In a preferred construction a pivot element is provided on each blade unit engaging portion so that the blade unit is pivotally mounted at its ends. The blade unit engaging portions are interconnected by a substantially rigid strut member, which serves to eliminate relative movement of the blade unit engaging portions which is undesirable. The engaging section includes an element for cooperating with the blade unit to resist pivotal movement of the blade unit about the longitudinal pivot axis. A spring element may be provided on one or each of the blade unit engaging portions for acting on the blade unit to resist pivoting about the longitudinal axis, but according to a preferred construction a spring element is carried by the interconnecting strut member. The spring element may consist of a leaf spring element positioned for bearing on the underside of the blade unit, and the spring element can be conveniently moulded integrally with the part, e.g. an engaging portion or the strut member, of the blade unit engaging section from which it extends.

According to another aspect, the invention resides in a support structure for mounting an elongate blade unit to a handle in a safety razor, the structure comprising a hub for attachment to the handle and a pair of arms extending symmetrically from the hub to respective blade unit engaging portions, each arm comprising a substantially rigid beam member having first and second ends respectively resiliently hingedly coupled to the hub and to the respective blade unit engaging portion, thereby to permit displacement of the engaging portions towards the handle in a predetermined movement plane, the arms restraining displacement of the engaging portions in directions transverse to said movement plane.

The beam member of each arm is preferably resiliently hingedly coupled to the hub and/or the respective engaging portion by a resiliently flexible arm portion which can be conveniently formed integrally with the beam member. According to a currently preferred construction each arm has the beam member and two resiliently flexible leaf spring portions interconnected substantially in Z configuration. In order to obtain an especially beneficial spring reaction characteristic in response to blade unit displacement, the leaf spring portions of each arm converge in a direction towards the blade unit, and in particular towards the blade unit engaging portion to which that arm is connected. Firm support against displacement of the blade unit transversely to the movement plane can be achieved by arranging each leaf spring portion to lie substantially in a plane which is substantially perpendicular to the movement plane, with the leaf spring portions of each arm converging to a point on the pivot axis where drag forces are delivered by or received from the blade unit during shaving. With the leaf spring portions so arranged, their respective longitudinal torsional axes are convergent toward points where drag loads can be resolved as being imparted, and with the points of convergence associated with the respective arms spaced apart longitudinally of the blade unit the blade unit is firmly supported against movement transverse to the desired movement plane. Adequate stiffness of the arms in the desired movement direction can be ensured by providing the leaf spring portions with an arcuate form with the curvature so oriented that upon displacement of the blade unit towards the handle the or each arcuate leaf spring portion initially straightens and then reverses its curvature, the leaf spring portion being essentially straight midway through the excursion of the arm from the normal rest position to the position of maximum displacement so as to incur the minimal possible deviation from straightness over the entire range of motion.

The blade unit supporting structure of the invention can be conveniently manufactured as a one piece moulding. It can be incorporated with a blade unit, in which case the hub of the support structure can be detachably connectable to the handle with the intention that the blade unit and support structure form a cartridge assembly to be replaced on the handle when the blade or blades of the blade unit have become dulled. Alternatively the support structure may be permanently connected to the handle with the blade unit being detachably mounted on the support structure so that only the blade unit needs to be replaced when a fresh blade unit with sharp blades is required for use. Of course, as a further alternative the support structure can be embodied in a safety razor of the kind which is intended to be discarded in entirety when the blades have become dulled. In this case the hub of the supporting structure and the handle would be integrally moulded. Yet another possibility is for the support structure to be detachably connectable to both the handle and the blade unit.

In the embodiments particularly described herein the blade unit connected to the engaging portions of the support structure by pivot elements in the form of journals, specifically pivot pins. According to a modified construction the blade unit is connected to the engaging portions through one or more flexural hinges defining the pivot axis, which arrangement opens the possibility of the support structure being integrally moulded with the frame of the blade unit.

A more complete understanding of the invention will be gained from the following detailed description of an exemplary embodiment, reference being made to the accompanying drawings in which.

Figure 1:
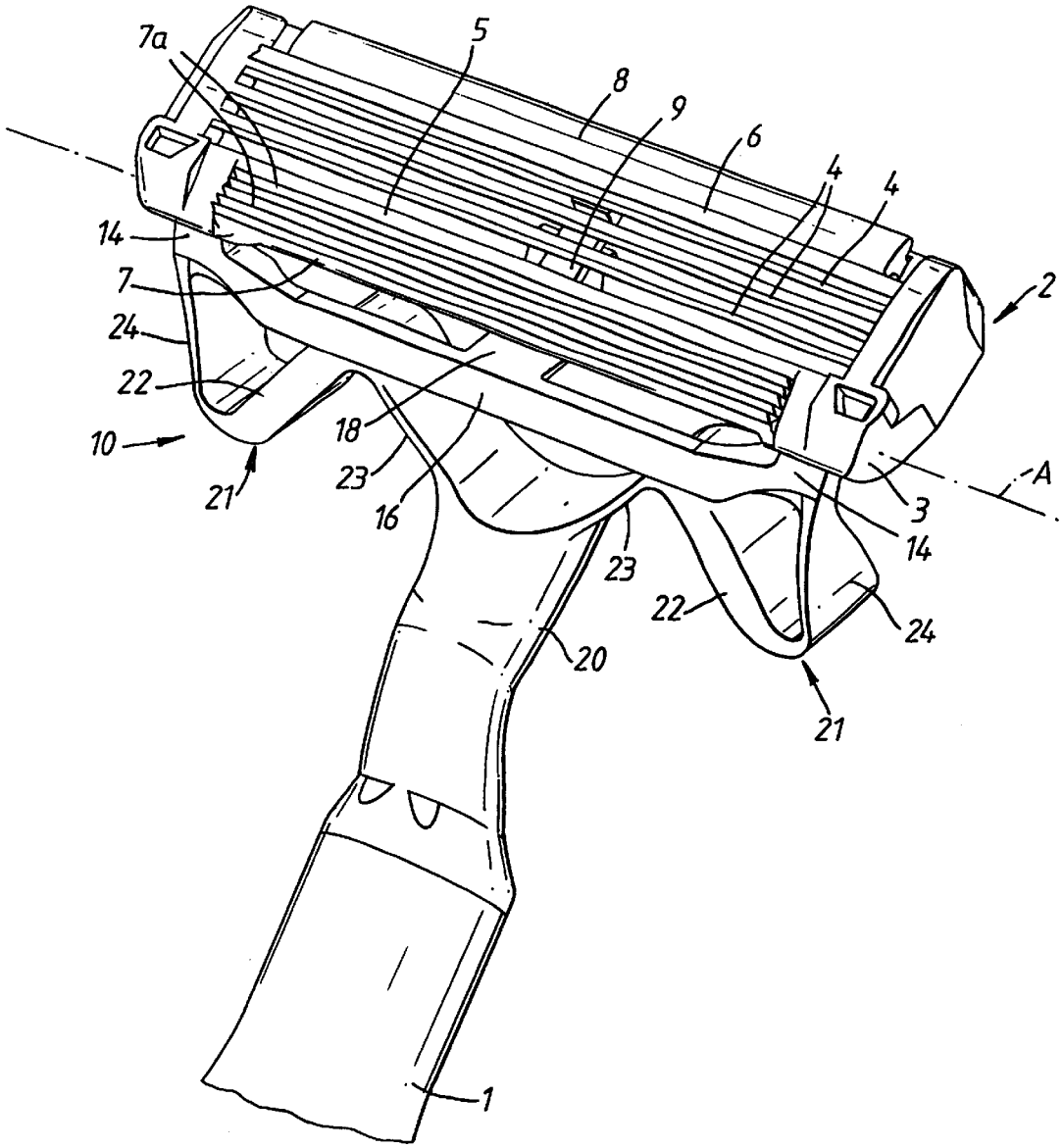
FIG. 1 shows in perspective a safety razor incorporating a blade unit supporting structure in accordance with the invention.
Figure 4:
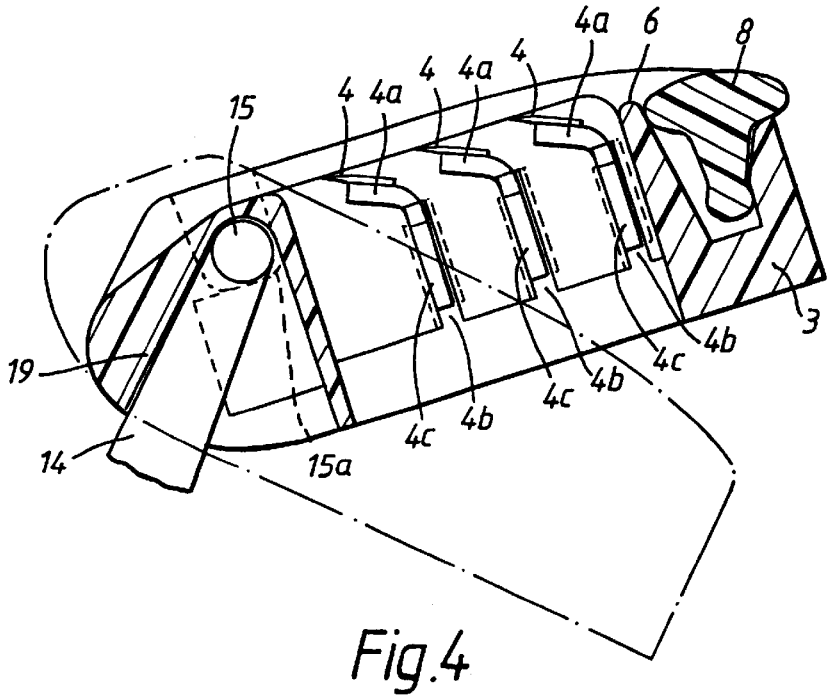
FIG. 4 is a partial sectional view illustrating the connection between the blade unit and the supporting structure.

Illustrated in FIG. 1 is a safety razor having a handle 1, only the upper end part of the handle structure being shown, and a blade unit 2. The blade unit includes an elongate, generally rectangular plastic frame 3 defining an opening in which one, two or, as shown, three blades 4 with rectilinear sharpened edges are mounted. The blades 4 can be fixed in the frame 3 or they can be mounted for movement in response to forces exerted on the blades during shaving, as known in the art. For example, the blades 4 may be mounted for independent movement against the action of springs 4*c* (FIG. 4) which bias the blades upwardly, the blades 4 being carried on respective supports 4*a* the ends of, which are received and guided in slots 4*b* formed in the end walls of the frame 3. The springs 4*c* may consist of plastic fingers moulded integrally with the frame or provided by a separate spring element inserted into the frame. The blade unit includes in conventional manner a guard 5 and cap 6 for contacting the skin in front of and behind the blades 4. As shown in FIG. 1 the guard 5 includes a series of longitudinal fins 7*a* which may be provided on a strip of elastomeric material 7, and the cap 6 includes a lubricating strip 8 for delivering a lubricant to the skin during shaving. Suitable materials for the lubricating strip 8 are those described in our U.S. Pat. No. 5113585 the contents of which are incorporated herein by reference. The elastomeric strip 7 may be provided with other forms of upward projection instead of the fins 7*a*, such as open ended tubes or crescent-shaped projections as respectively described in our International Patent Application Nos. WO 97/25190 and WO 97/33729 the contents of which are incorporated herein by reference. Suitable elastomeric materials for the strip 7 are those mentioned in U.S. Pat. No. 5249361, the contents of which are also incorporated herein by reference.

The blade unit 2 is suspension mounted on the handle 1 by a supporting structure 10 which is made as a one piece plastic moulding. The support structure 10 includes an upper blade unit engaging structure or section 11 which carries the blade unit, and a suspension structure or section 12 which connects the blade unit engaging section 11 to a lower structure in the form of a hub 20 attaching to the handle 1. As shown most clearly in FIGS. 2 and 3, the blade unit engaging section 11 includes two blade unit engaging portions 14 each provided with a pivot element 15 in the form of a cylindrical pin. The pivot pins 15 are located at opposite ends of the support structure 10 and are in axial alignment, the pivot pins being directed away from each other for engagement in socket journals 15A (FIG. 4) provided in the ends of the blade unit frame 3. The pivot pins 15 define a longitudinal pivot axis A which extends lengthwise of the blade unit 2 that is substantially parallel to a longitudinal axis of the blade and to the sharpened edges of the blades 4. The engaging portions 14 are connected together by a substantially rigid cross member or strut 16 which holds the engaging portions 14 against relative movement, in particular against movement towards and away from each other which is undesirable, firstly since it might lead to the pivot pins 15 disengaging from their sockets 15A, and secondly since it could result in movements of the blade unit 2 parallel to the blade edges with the associated risk of the blades slicing the skin. A spring element 18 in the form of a curved leaf spring extends rearwardly and upwardly from the mid-portion of the cross strut 16, this spring 18 acting on a transverse rail 9 provided on the underside of the blade unit frame 3. The spring 18 opposes pivotal movement of the blade unit 1 from a normal rest position into which it is biased by the spring 18. The rest position can be defined by the engaging portions 14 of the support structure abutting against stop surfaces 19 provided at the ends of the blade unit frame 3, as may be seen in FIG. 4.

Figure 2:
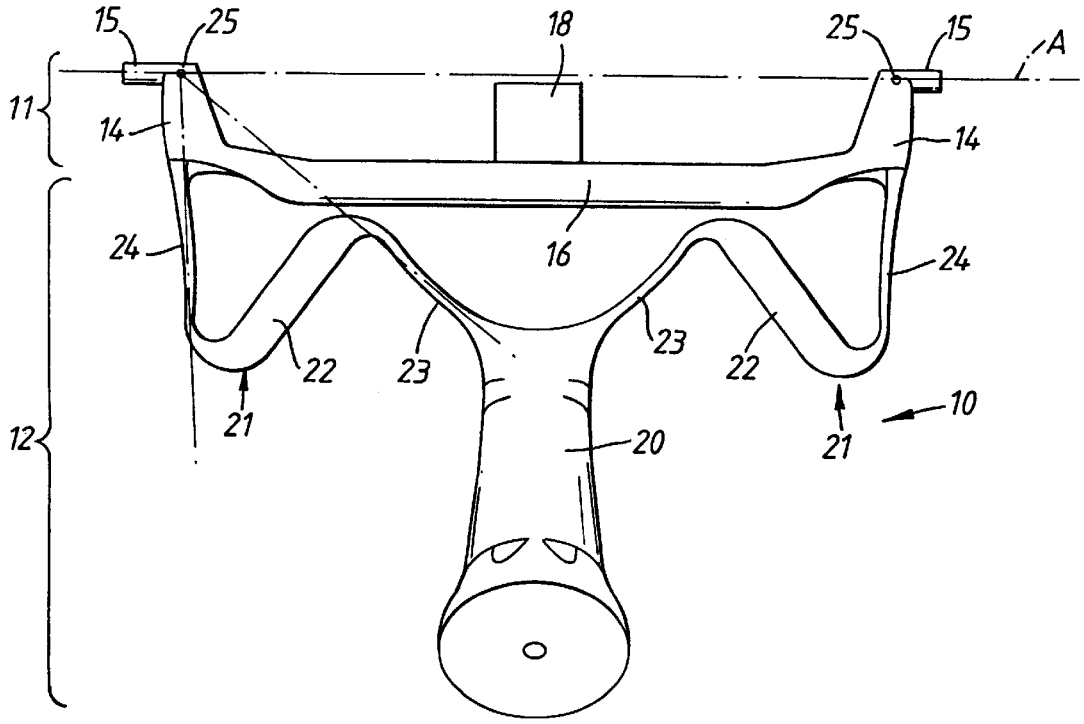
FIG. 2 shows the support structure in front elevation.
Figure 3:
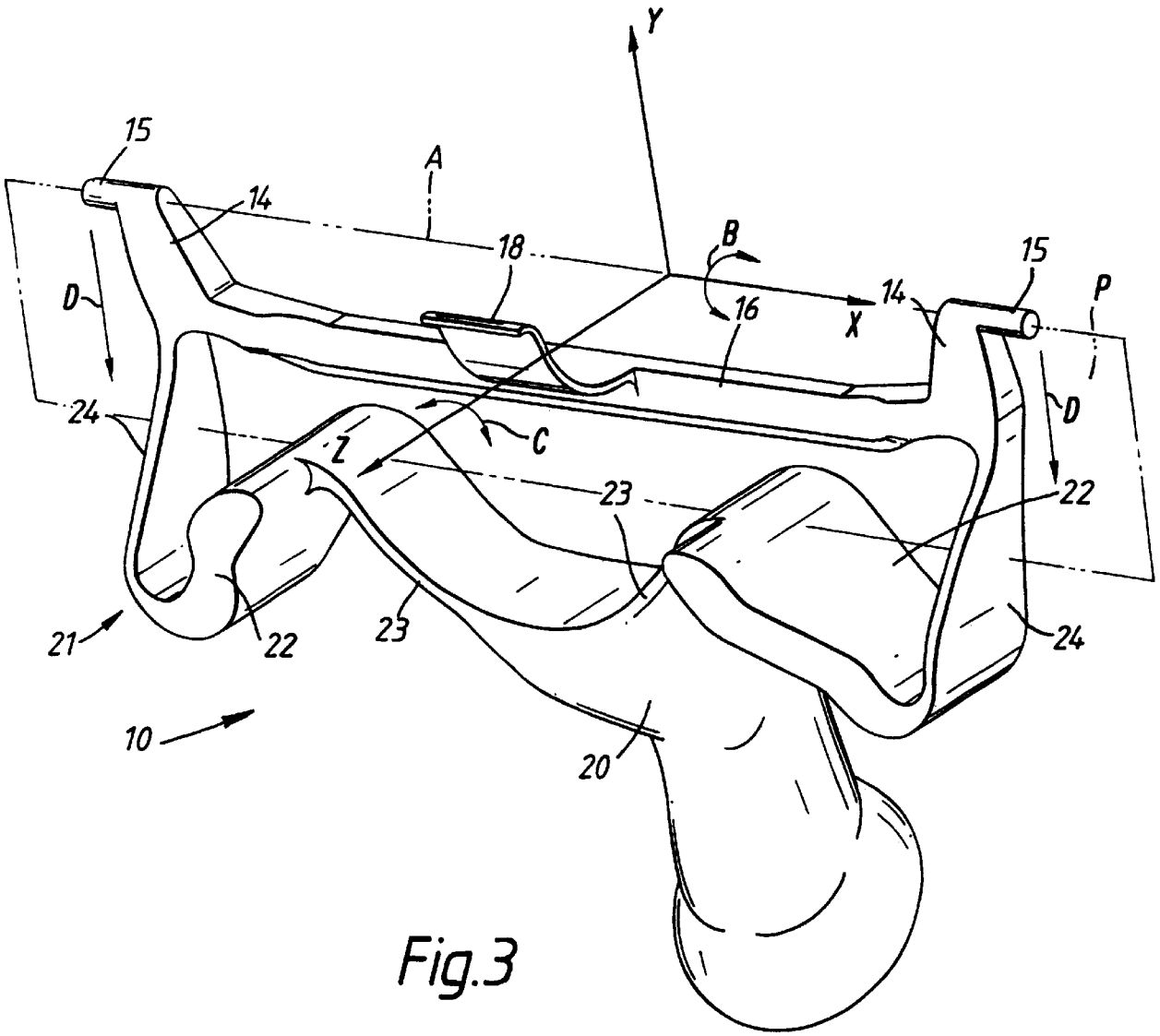
FIG. 3 is a rear perspective view of the support structure.

The suspension section 12 of the support structure 10 includes a lower structure attaching to the handle 1 and in the form of a hub 20 which is attached firmly to the upper end of the handle 1 and, as shown, forms an extension of the handle. Extending symmetrically from the hub 20 are a pair of lateral suspension arms 21, each of which comprises three sections or limbs 22,23,24 connected end-to-end in a Z-shape configuration to allow certain movements of the blade unit while restraining others as explained in detail below. One end of each arm 21 is attached to the hub 20 and the other end is attached to a respective engaging portion 14. Each arm 21 includes a rigid central beam 22 and resiliently flexible leaf springs 23 and 24 connected to the opposite ends of the beam 22. Thus, each leaf spring 23 has a proximal end connected to the hub 20 and a distal end connected to the proximal end of the respective beam 22, and each leaf spring 24 has a proximal end connected to the distal end of the associated beam 22 and a distal end connected to the respective engaging portion 14. As shown most clearly in FIG. 2, the leaf springs 23,24 are connected to the beams 22 at angles of approximately 90° or less, and the beams 22 of the two arms diverge from each other in the direction towards the handle 1, the leaf springs 23,24 of each arm 21 thereby being so orientated that the leaf springs, and more importantly their respective longitudinal torsional axes, converge towards a point 25 located substantially on the pivot axis A. The leaf springs 23,24 of each arm 21 are shown to converge towards points 25 located where pivot pins 15 join the engaging portions 14 and hence adjacent the respective ends of the blade unit. As best seen in FIG. 2, the leaf springs 23,24 are slightly curved, the curvature being in such a direction that the leaf springs tend initially to straighten as a result of the resilient deformation of the arms 21 brought about by the blade unit 2, and hence the engaging portions 14, being displaced towards the handle 1. The leaf springs 23,24 function as resiliently flexible hinged couplings between the proximal ends of the beams 22 and the hub 20, and between the distal ends of the beams 22 and the engaging portions 14 of the engaging section 11 of the support structure. Whilst the arms 21 permit displacement of the engaging portions 14 in a downward direction D generally towards the hub 20 and the handle 1, the arms 21 are substantially rigid in the direction Z perpendicular to the movement plane (XY plane) to support the engaging portions 14 against movement backwards and forwards perpendicular to the downward direction D. The rigidity in the latter direction is due to the orientation of the torsional axes of the leaf springs 23,24 of the two arms 21 as described above.

Figure 5:
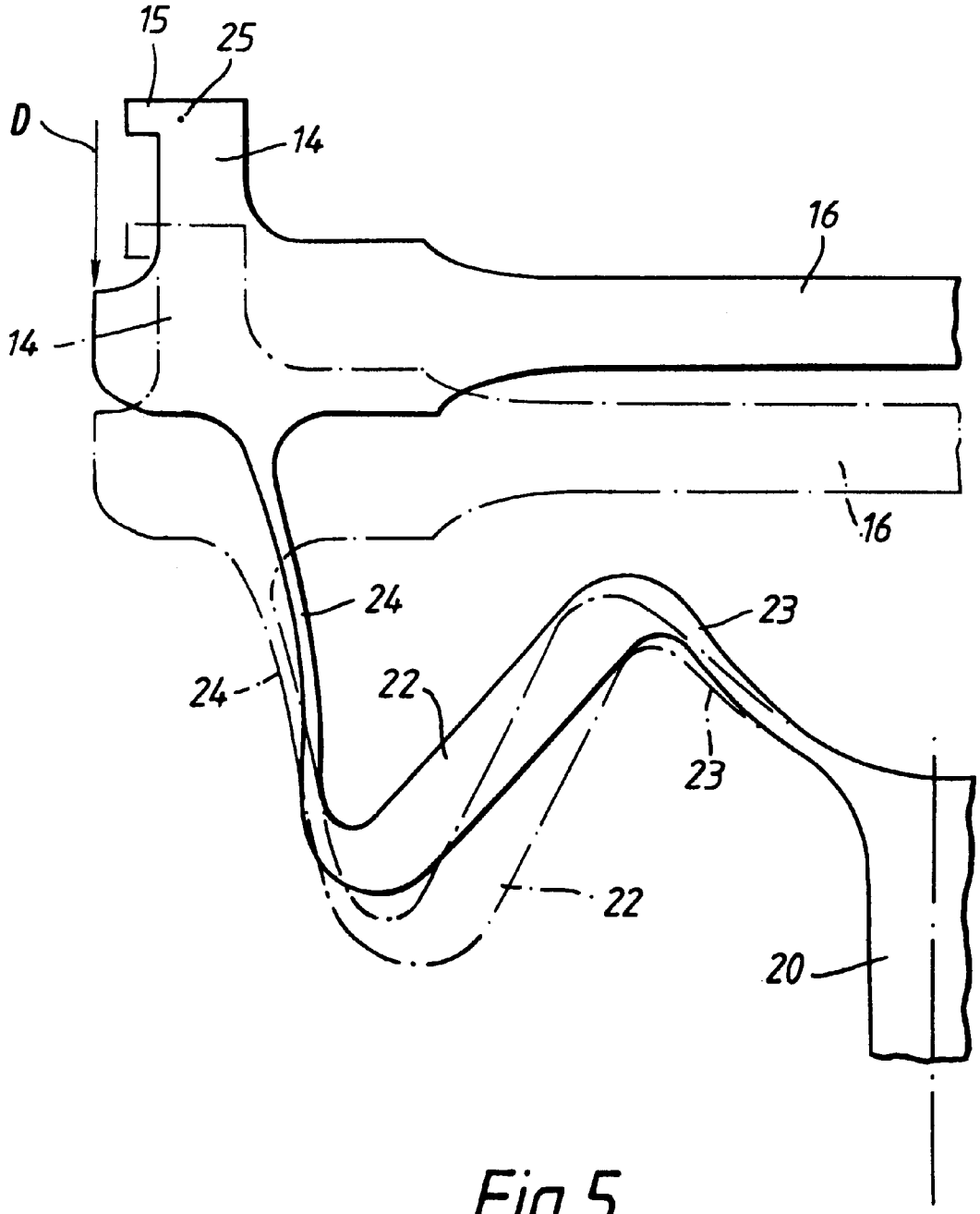
FIG. 5 is partial front elevation showing the resilient deformation at one of the suspension arms.

FIG. 5 illustrates the resilient deformation of one suspension arm as may be brought about by load forces imparted on the blade unit during shaving. In the drawing the normal rest position is shown in full line and position of partial deflection is drawn in broken line. During an initial part of the excursion of the blade unit engaging portion 14 downwardly towards the hub 20, the leaf springs 23, 24 straighten from their initial curved forms, and essentially straight condition being attained, as shown in dotted line, when the engaging portion 14 is substantially midway between the normal rest position of maximum displacement. As the engaging portion 14 continues to move towards the hub, beyond the midway position, the leaf springs 23,24 reverse the curvature. It will be noted that the midpoint of the outer leaf spring 24 is initially at a small distance above the midpoint of the inner leaf spring 23, and the midpoint. alignment is reversed when the leaf springs 23,24 are straight at the mid-position through the full excursion of the engaging portion so that the midpoint of leaf spring 24 is then below that of leaf spring 23 by the same distance as it was initially thereabove. As displacement of the engaging portion 14 continues, the midpoint of the outer leaf spring 24 moves so that it is increasingly far below the midpoint of the inner leaf spring 23. Over the latter part of the depression of the engaging portion 14, the spring resistance of the arm 21 increases relatively rapidly with the deformation of the suspension arm, thereby limiting the maximum downward displacement likely to occur during shaving. The shaping and relative positioning of the leaf springs 23,24 as described means that the leaf springs remain substantially straight during normal deflections of the spring arms 21. This ensures desirable downward travel of a blade unit under load forces during shaving is accommodated to allow the blade unit to follow skin contours, but the spring arms 21 can still be relied upon to minimise excessive travel in the downward direction.

From the foregoing description it will be understood that the pivot pins 15 of the support structure 10 supports the blade unit 2 for pivotal movement with respect to the longitudinal axis A, and pivotal movement away from the rest position defined by the stop surface 19 is opposed by the leaf spring 18. However, the return force generated by the leaf spring 18 is independent of any movement of the blade unit 2 due to flexing the spring arms 21. The pivotal movement of the blade unit about the axis A may be considered a pitching motion (arrow B) of the blade unit. The arms 21 support the respective engaging portions 14 and hence the opposite ends of the blade unit 2 for independent movement in the direction D generally towards the hub 20 and handle 1, whereby tilting of the blade unit about an axis Z transverse to the longitudinal axis A is permitted. The position of the transverse axis Z is not fixed and at any particular instant will depend upon the relative degree of flexing of the two arms 21. This tilting or rocking movement can be considered to be a rolling motion (arrow C) of the blade unit. Furthermore, equal flexing of the arms 21 allows translational movement of the blade unit towards the hub 20 and hence the handle 1 in a direction which, in use, will be generally perpendicular to a plane tangential to the skin contacting surfaces of the blade unit guard 5 and cap 6. While these movements, which are desirable with a view to the blade unit 2 following the skin contours during shaving, are enabled, undesirable displacement of the blade unit 2 parallel to the longitudinal axis A is prevented by the arms 21, as is displacement of the blade unit in the direction Z perpendicular to the plane defined by axis A and the direction D of movement allowed by flexing the arms 21. The orientation of the leaf springs 23,24 as described above means that they will present maximum rigidity against forces derived from drag forces exerted on the blade unit 2 during shaving, whereas load forces directed substantially normally to the skin surface will result in flexing of the suspension arms 21 to enable the blade unit 2 to maintain close conformity with the skin as the skin contours change. Because the leaf springs 23,24 remain substantially straight, it is ensured that these springs at all times maintain rigidity against, and thereby minimal tendency to deform under drag related forces. The form of the suspension arms 21 ensures that the resistance to deflection of the engaging portions 14 rapidly increases as the portions 14 approach a maximum deflection so that a user of the razor is unlikely to cause the suspension to bottom out by pressing blade unit too heavily against the skin.

From the foregoing description it will be understood that the described support structure 10 enables the blade unit 2 to pitch and roll, and move in a direction D substantially perpendicular to a plane defined by the pitch and roll axes X and Z, respectively, which movements permit the blade unit 2 to follow the skin contours during shaving, but the blade unit is supported to firmly resist yawing motion about axis Y as well as displacements parallel to the pitch and roll axes X and Z, respectively.

Figure 6:
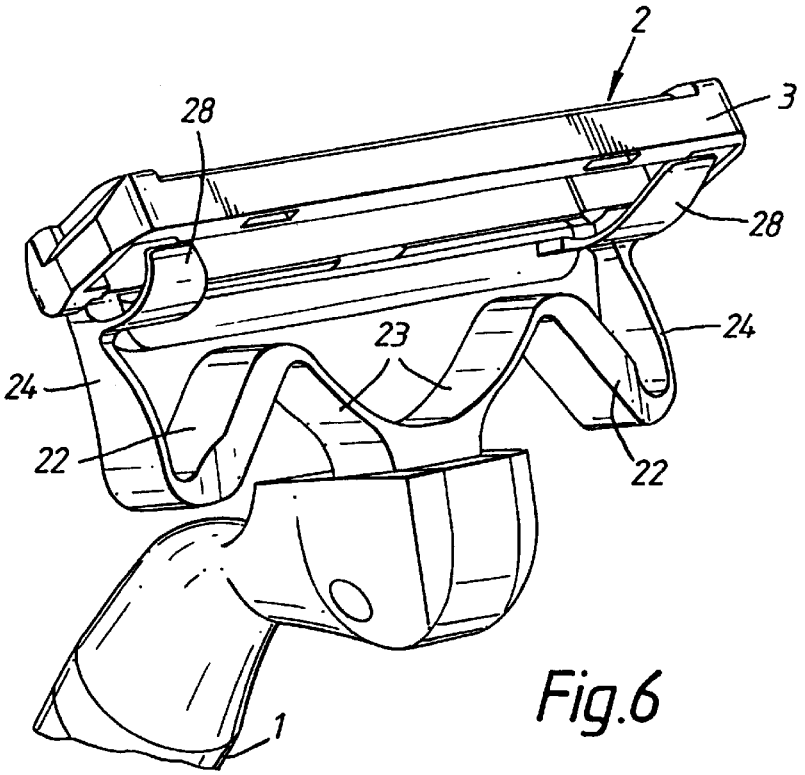
FIG. 6 shows a razor with a modified blade unit support structure embodying the invention.
Figure 7:
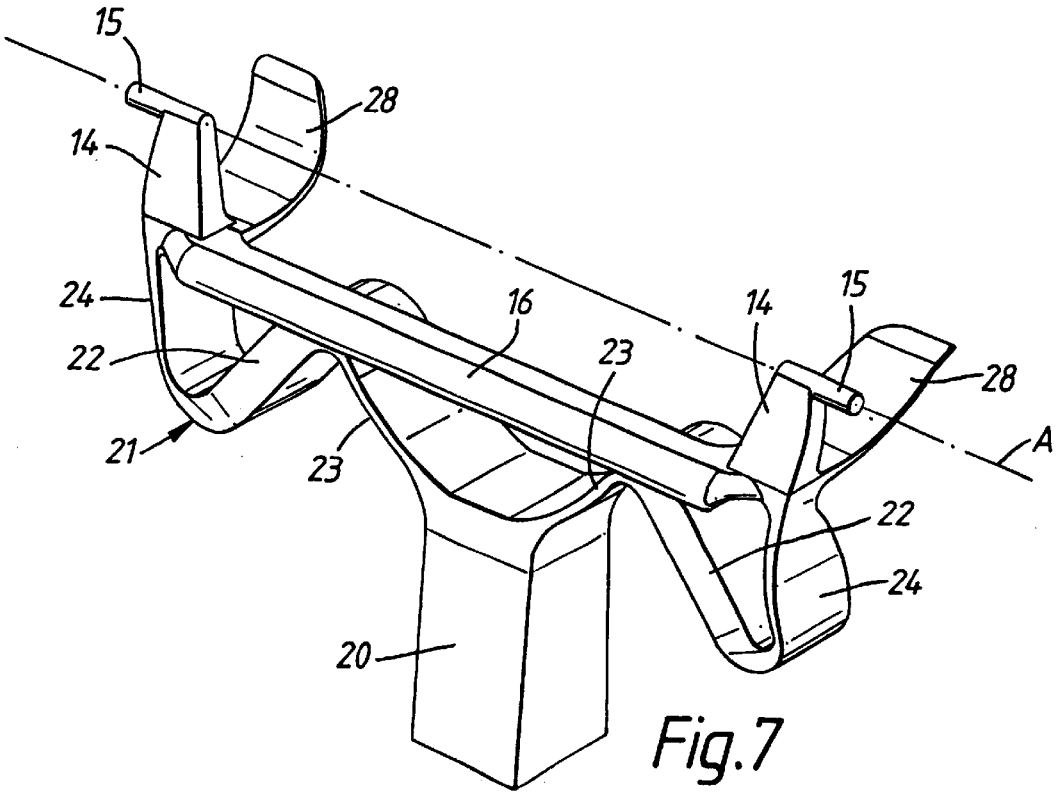
FIG. 7 is a front perspective view of the modified support view of the modified support structure of the razor shown in FIG. 4.

A modified blade unit support structure is shown in FIGS. 6 and 7. The structure has essentially the same form and functions in the same way as the embodiment described above, but it differs that instead of the leaf spring 18 a pair of leaf springs 28 are connected to the engaging portions 14 for acting on the blade unit 2 to resist pivotal movement about the longitudinal pivot axis A and to bias the blade unit to a rest position about that axis.

Other modifications are of course possible. For example it is not essential to have two pivot elements carried by the engaging portions 14 located adjacent the ends of the blade unit and it would be feasible to have a single pivot element located medially along the cross-strut 16 which could have the form of a platform rather than a bar. Of course appropriate measures would be required to ensure that forces are transferred from the blade unit to the engaging section of the supporting structure so that the structure will respond to allow the desired blade unit movements. The or each pivot element can be in the form of a flexural connection and a pin joint is not essential.

In the embodiments of the invention particularly described herein the blade unit 2 comprises a frame 3 carrying one or more blades 4 with straight cutting edges extending lengthwise of the blade unit. However, the invention is also applicable to razors having foils having apertures provided with sharpened edges rather than elongate blades.

From the foregoing description it will be appreciated that the invention provides, according to an especially expedient embodiment, a blade unit suspension which can be conveniently made in one piece as a moulding and which holds the blade unit securely against any displacement under the effect of drag forces imposed on the blade unit during shaving whilst enabling the blade unit to move pivotally and under load forces to follow the skin contours.

While it is apparent that modifications and changes can be made within the spirit and scope of the present invention, it is our intention, however, only to be limited by the appended claims.

What is claimed is:

1. A shaving razor structure for supporting an elongate blade unit comprising:

a handle structure, a blade unit engaging structure for engaging said blade unit and providing pivotal mounting of said blade unit about a pivot axis parallel to a longitudinal axis of said blade unit, and resiliently deformable arm structure connected between said handle structure and said blade unit engaging structure for permitting displacement of the engaging structure and the blade unit downwardly towards the handle structure and restraining movement of the engaging structure and the blade unit in a direction substantially perpendicular to the direction of downward displacement.

2. The razor structure of claim 1 wherein said arm structure restrains movement of the engaging structure in a direction substantially perpendicular to a movement plane defined by said direction of downward displacement and said pivot axis.

3. The razor structure of claim 2 wherein said arm structure restrains movement of the engaging structure in a direction substantially parallel to said longitudinal axis.

4. The razor structure of claim 3 wherein said arm structure comprises further comprising a hub connected between said arms and said handle structure.

5. The razor structure of claim 4, wherein each arm comprises a substantially rigid beam member having the ends thereof respectively resiliently hingedly connected to the hub and to the blade unit engaging structure.

6. The razor structure according to claim 5, wherein the beam member of each arm is resiliently hingedly coupled to at least one of the hub and the blade unit engaging structure by a resiliently flexible arm portion.

7. The razor structure according to claim 6, wherein the resiliently flexible arm portion is integral with the beam member.

8. The razor structure according to claim 7, wherein the resiliently flexible arm portion has the form of a leaf spring.

9. The razor structure according to claim 8, wherein the leaf spring has an arcuate form, and its curvature is directed so that the leaf spring straightens and then reverses its curvature in response to displacement of the blade unit engaging structure towards the handle.

10. The razor structure according to claim 9, wherein the leaf spring is straight substantially midway through the displacement of the blade unit from a rest position to a position of maximum displacement.

11. The razor structure according to claim 5, wherein each arm has the beam member connected between two leaf spring portions in a Z configuration.

12. The razor structure according to claim 11, wherein each leaf spring portion lies substantially in a plane substantially perpendicular to the movement plane and the leaf spring portions of each arm are convergent towards the blade unit.

13. The razor structure according to claim 12, wherein the leaf spring portions of each arm converge towards the blade unit engaging structure attached to that arm.

14. The razor structure according to claim 13, wherein the leaf spring portions are convergent to a point substantially on the pivot axis.

15. The razor structure of claim 4 wherein said blade unit engaging structure comprises pivot elements for pivotal engagement with the blade unit adjacent the ends thereof.

16. The razor structure of claim 15, wherein each pivot element comprises a pin for engagement in a journal provided on the blade unit.

17. The razor structure according to claim 15, wherein said blade unit engaging structure comprises a strut member interconnecting the pivot elements and holding said pivot elements against movement relative to each other.

18. The razor structure as claimed in claim 17, wherein the blade unit engaging structure includes a spring element provided on said strut member for cooperating with the blade unit to resist pivotal movement of the blade unit.

19. The razor structure according to claim 18, wherein said spring element is positioned to bear on the underside of the blade unit.

20. The razor structure of claim 18 wherein the spring element is integral with the pivot element or the strut member on which it is carried.

21. The razor structure as claimed in claim 15, wherein each said pivot element has a spring element for cooperating with the blade unit to resist pivotal movement of the blade unit.

22. The razor structure of claim 1 wherein said arm structure restrains movement of the engaging structure in a direction substantially parallel to said longitudinal axis.

23. The razor structure according to claim 1, wherein the blade unit engaging structure includes a spring element for cooperating with the blade unit to resist pivotal movement of the blade unit.

24. The razor structure according to claim 1, wherein the blade unit engaging structure and the resiliently deformable arm structure are made as a one piece moulding.

25. The razor structure according to claim 1, wherein the resiliently deformable arm structure is incorporated with a blade unit in a shaving cartridge for detachable mounting on a razor handle.

26. The razor structure according to claim 1, wherein the resiliently deformable arm structure is firmly attached to the handle structure and a blade unit is detachably mountable on the engaging structure.

27. A blade unit supporting structure for suspension mounting of an elongate blade unit, the structure comprising:

a blade unit engaging section including at least one pivot element defining a pivot axis substantially parallel to the length of the blade unit for pivotal movement of the blade unit about said axis;

a suspension section including a hub and a pair of arms extending symmetrically from the hub and connected to respective portions of the blade unit engaging section disposed to be adjacent opposite ends of the blade unit;

the arms being resiliently deformable to allow displacement of the engaging section and the blade unit downwardly towards the hub, while restraining movement of the engaging section and the blade unit in a direction substantially perpendicular to a movement plane defined by said direction of downward displacement and said pivot axis.

28. A blade unit supporting structure according to claim 27, wherein the or each pivot element comprises a pin for engagement in a journal provided on the blade unit.

29. A blade unit supporting structure as claimed in claim 28, wherein a pivot element is carried by each of said portions of the engaging section for pivotal engagement with the blade unit adjacent the ends thereof.

30. A blade unit supporting structure according to claim 27, wherein the engaging section includes a strut member interconnecting the said portions of the engaging section and holding said portions against movement relative to each other.

31. A blade unit supporting structure as claimed in claim 30, wherein a spring element for resisting pivotal movement of the blade unit is provided on the strut member.

32. A blade unit supporting structure according to claim 27, wherein the engaging section includes an element for cooperating with the blade unit to resist pivotal movement of the blade unit.

33. A blade unit supporting structure according to claim 32 wherein the element for cooperating with the blade unit is a spring element provided on at least one of said portions of said engaging section.

34. A blade unit supporting structure as claimed in claim 33, wherein the spring element is a leaf spring positioned to bear on the underside of the blade unit.

35. A blade unit supporting structure as claimed in claim 33, wherein the spring element is integral with the engaging section or the strut member on which it is carried.

36. A blade unit supporting structure according to claim 27, wherein each arm comprises a substantially rigid beam member having the ends thereof respectively resiliently hingedly connected to the hub and to the respective portion of the engaging section.

37. A blade unit supporting structure according to claim 27, wherein the supporting structure is made as a one piece moulding.

38. A blade unit supporting structure according to claim 27, wherein the supporting structure is incorporated with a blade unit in a shaving cartridge for detachable mounting on a razor handle.

39. A blade unit supporting structure according to claim 27, wherein the supporting structure is firmly attached to a razor handle and a blade unit is detachably mountable on the blade unit engaging section.

40. A blade unit supporting structure for suspension mounting of an elongate blade unit to a handle in a safety razor, the structure comprising:

a lower structure for attaching to the handle;

an upper structure for engaging the blade unit; and a pair of arms extending symmetrically with respect to a handle axis from the lower structure to the upper structure;

each arm comprising a substantially rigid beam member having first and second ends respectively resiliently hingedly coupled said upper and lower structure; and the arms permitting the upper and lower structures to move towards each other in a predetermined movement plane, while restraining displacement of the upper structure in a direction transverse to said movement plane.

41. A blade unit supporting structure according to claim 40, wherein at least one end of the beam member of each arm is resiliently hingedly coupled by a resiliently flexible arm portion to the upper or lower structure.

42. A blade unit supporting structure according to claim 41, wherein the resiliently flexible arm portion is integral with the beam member.

43. A blade unit supporting structure according to claim 39, wherein each arm has the beam member connected between two leaf spring portions in a Z configuration.

44. A blade unit supporting structure according to claim 43, wherein each leaf spring portion lies substantially in a plane substantially perpendicular to the movement plane and the leaf spring portions of each arm are arranged to converge towards the blade unit.

45. A blade unit supporting structure according to claim 44, wherein the leaf spring portions of each arm converge towards a portion of the blade unit engaging section to which that arm is connected.

46. A blade unit supporting structure according to claim 45, wherein the blade unit engaging section is arranged to support the blade unit for pivoting about a longitudinal axis of the blade unit and the leaf spring portions are convergent to a point substantially on the pivot axis.

47. A blade unit supporting structure according to claim 41, wherein the resiliently flexible arm portion has the form of a leaf spring.

48. A blade unit supporting structure according to claim 47, wherein the leaf spring has an arcuate form and its curvature is directed so that the leaf spring straightens and then reverses its curvature as the upper and lower structures move towards each other.

49. A blade unit supporting structure according to claim 48, wherein the leaf spring is substantially straight midway through the movement of the upper and lower structures from a rest position to a position of minimum distance apart.

* * * * *